US010222180B2

(12) United States Patent
Tien

(10) Patent No.: US 10,222,180 B2
(45) Date of Patent: Mar. 5, 2019

(54) PLATE CARRIER

(71) Applicant: Spencer Tien, Irwindale, CA (US)

(72) Inventor: Spencer Tien, Irwindale, CA (US)

( * ) Notice: Subject to any disclaimer, the term of this patent is extended or adjusted under 35 U.S.C. 154(b) by 347 days.

(21) Appl. No.: 14/997,889

(22) Filed: Jan. 18, 2016

(65) Prior Publication Data

US 2017/0205204 A1 Jul. 20, 2017

(51) Int. Cl.
*F41G 1/02* (2006.01)
*F41H 1/02* (2006.01)

(52) U.S. Cl.
CPC ..... *F41H 1/02* (2013.01)

(58) Field of Classification Search
CPC ..... A41H 1/02
See application file for complete search history.

(56) References Cited

U.S. PATENT DOCUMENTS

2008/0235841 A1* 10/2008 McDunn ..... F41H 1/02 2/2.5
2009/0211000 A1* 8/2009 Roux ..... F41H 1/02 2/462
2010/0088799 A1* 4/2010 Carter ..... F41H 1/02 2/102
2010/0115680 A1* 5/2010 Thomas ..... F41H 1/02 2/2.5

* cited by examiner

*Primary Examiner* — Andrew W Sutton
(74) *Attorney, Agent, or Firm* — Clement Cheng

(57) ABSTRACT

A plate carrier for carrying body armor has a front panel having a front connector panel, a rear panel behind the front panel, and a pair of side panels connected to the rear panel. The pair of side panels includes a right side panel and a left side panel. The right panel includes a right inside connector panel that connects to the front connector panel. The left panel includes a left inside connector panel that connects to the front connector panel. An outside flap panel extends from a lower edge of the front panel. The outside flap panel includes an inside connector panel mounted on an inside surface of the outside flap panel. The inside connector panel overlies the pair of side panels.

15 Claims, 7 Drawing Sheets

PLATE CARRIER

FIELD OF THE INVENTION

The present invention is in the field of body armor, more specifically plate carriers.

DISCUSSION OF RELATED ART

A variety of plate carriers have been used for body armor.

SUMMARY OF THE INVENTION

A plate carrier for carrying body armor has a front panel having a front connector panel, a rear panel behind the front panel, and a pair of side panels connected to the rear panel. The pair of side panels includes a right side panel and a left side panel. The right panel includes a right inside connector panel that connects to the front connector panel. The left panel includes a left inside connector panel that connects to the front connector panel.

An outside flap panel extends from a lower edge of the front panel. The outside flap panel includes an inside connector panel mounted on an inside surface of the outside flap panel. The inside connector panel overlies the pair of side panels. The right side panel has a right side connector panel, and the left side panel has a left side connector panel. The inside connector panel of the outside flap panel secures to the right side connector panel and the left side connector panel when the outside flap panel is folded up to a closed position after the pair of side panels are secured to the front panel.

The inside connector panel is configured to attach to the pair of side panels and secure to the front connector panel when the outside flap panel is folded over the pair of side panels after the pair of side panels are secured to the front panel. A pair of shoulder straps can connect the front panel to the back panel. The outside flap is a magazine panel having webbing strips. The mounting loops are formed on the webbing strips. The outside flap is a magazine panel having a magazine pouch. The outside flap further includes a pair of magazine panel connectors that connect the outside flap to the front panel.

The plate carrier for carrying body armor optionally includes a pair of magazine panel connectors. The pair of magazine panel connectors includes a left magazine panel connector and a right magazine panel connector. Each of the pair of magazine panel connectors includes a magazine panel connector socket configured to receive a magazine panel connector clip. The magazine panel connector socket further includes a lower socket slot opening, and an upper socket slot opening. A base tab is configured to fit through the lower socket slot opening and protrude from the upper socket slot opening. The base tab is removable from the magazine panel connector socket. The base tab secures the magazine panel connector socket to a mounting loop. The mounting loop is formed on a webbing strip. Three magazine pouches can be attached to the magazine panel.

Figure 1:
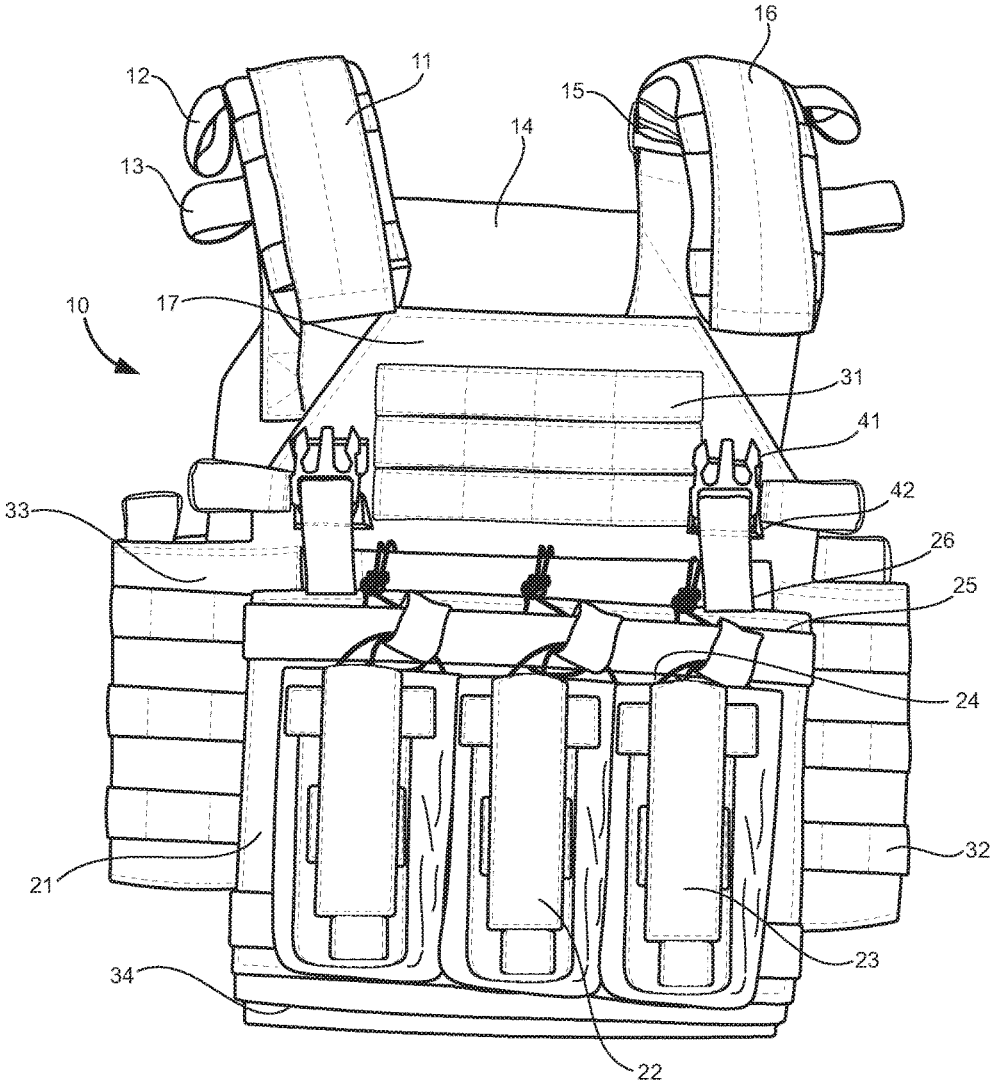
FIG. 1 is a front view of the plate carrier with the magazine panel connectors disengaged to show the magazine panel connector clips.
Figure 2:
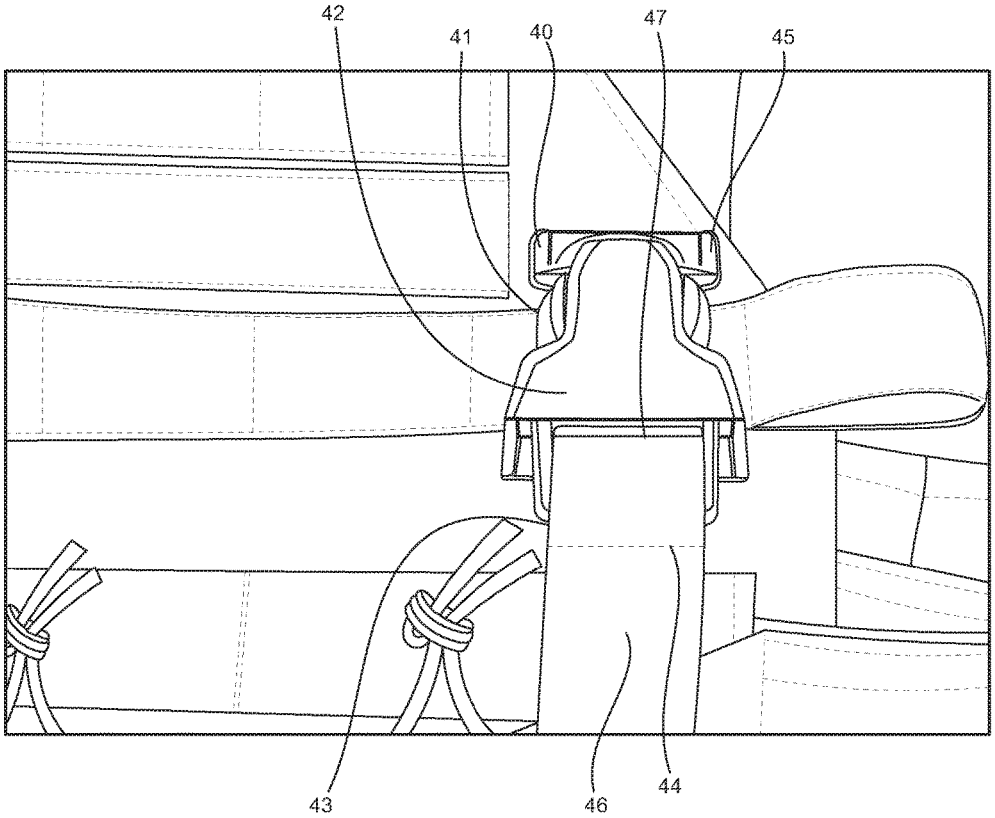
FIG. 2 is a close-up view of a magazine panel connector with the magazine panel connector clip engaged in the magazine panel connector socket.
Figure 3:
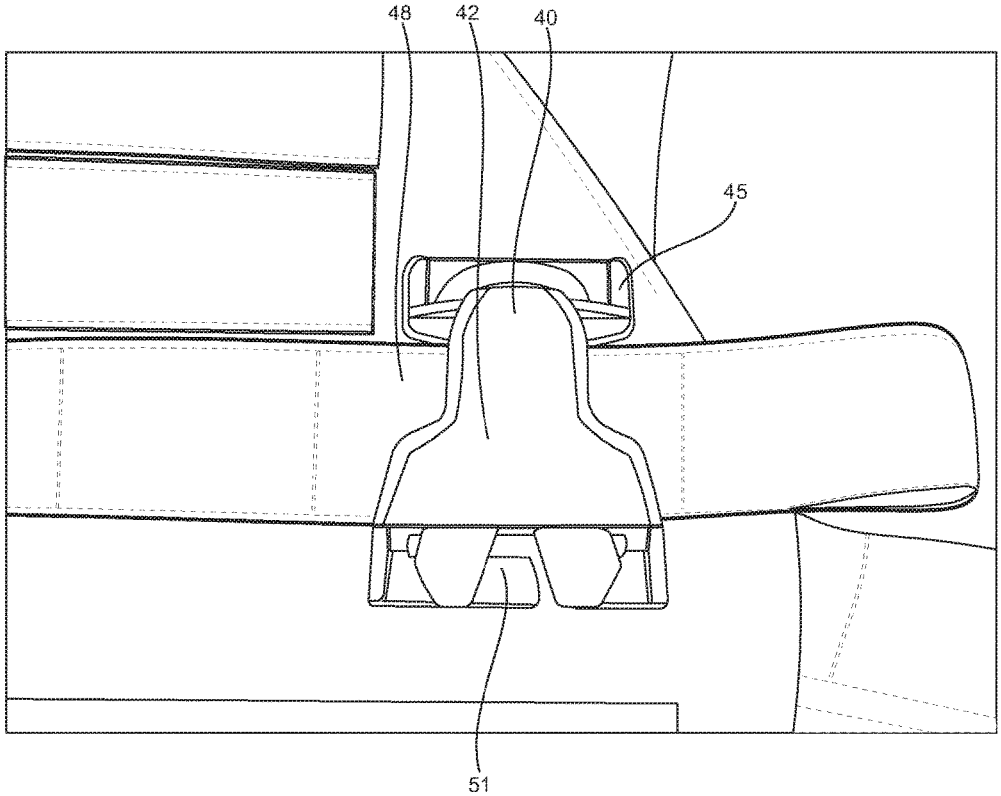
FIG. 3 is a close-up view of the magazine panel connector socket.

The following call out list of elements can be a useful guide in referencing the element numbers of the drawings.

10 torso plate carrier
11 right shoulder strap
14 back panel
15 shoulder strap buckle
16 left shoulder strap
17 front panel
20 outside flap panel
21 magazine panel
22 magazine pouch
23 magazine strap cover
24 magazine tension line
25 looped connector strip
26 magazine panel connector straps
30 side panel pair
32 left side panel
33 right side panel
34 plate insertion openings
40 magazine panel connector
41 magazine panel connector clip
42 magazine panel connector socket
43 connector clip loop
44 connector clip stitch
45 magazine panel socket base
46 magazine panel connector strap upper end
47 loop opening
48 base tab legs
49 mounting loop
50 socket attachment
51 lower socket slot opening
52 upper socket slot opening
53 socket ridge
54 base tab
55 base tab opening
60 connector panel system
61 magazine panel inside surface
62 right side connector panel
63 side panel grip projection flap
64 folding area
65 webbing strips
66 side panel base strip
67 left side connector panel
68 inside surface connector panel
71 right inside connector panel
72 right inside strip
73 front connector panel
74 left inside strip
75 side panel concavity
76 left inside connector panel

DETAILED DESCRIPTION OF THE PREFERRED EMBODIMENT

Glossary

MOLLE is an acronym for Modular Lightweight Load-carrying Equipment

PALS is an acronym for Pouch Attachment Ladder System

As seen in the first figure, a right shoulder strap 11 and a left shoulder strap 16 cooperate to fit over the shoulders of a user. A back panel 14 opposes a front panel 17. The shoulder straps can be adjusted using the shoulder strap buckle 15. The back panel 14 can have a bullet resistant plate carried within a rear plate pocket of the back panel 14. The front panel 17 can also have a bullet resistant plate carried within a front plate pocket of the front panel 17. Thus, the torso armor can protect the user by sandwiching the user between a pair of plates. The plates can be inserted into plate insertion openings 34 formed on a lower edge of the front panel 17 and the back panel 14. The plate insertion openings 34 can be closed by hook and loop tape fabric panels. The right shoulder strap 11, and the left shoulder strap 16 can also have accessory straps such as an upper accessory strap 12 and a lower accessory strap 13. The accessory straps can retain cables, antenna or other types of equipment.

The torso plate carrier 10 includes a front panel 17 and a back panel 14 that are connected together by a pair of side panels. A pair of side panels forms a side panel pair 30 which includes a right side panel 33 and a left side panel 32. A right side panel 33 and a left side panel 32 are connected to the back panel 14 and provide an adjustable connection to the front panel 17. An outside flap panel 20 includes a magazine panel 21 and optionally one or more magazine pouches 22 attached on the magazine panel 21. The outside flap panel 20 fold up to connect to the front panel 17.

The magazine panel 21 has a magazine panel lower edge that is pivotally connected to the front panel 17 at a lower edge of the front panel 17. The magazine panel 21 can have multiple a magazine pouches 22 such as three magazine pouches in the front. Each magazine pouch can have a magazine strap cover 23 mounted over the magazine pouch for providing a secure retention. Additionally, a magazine tension line 24 can retain the magazine within the magazine pouch. The magazine tension line 24 can be looped through a looped connector strip 25. The looped connector strip is horizontally oriented along an upper portion of the magazine panel 21 and has vertical stitching to provide sectioned loops. The magazine tension line 24 can be looped around vertical stitching that is located above an upper opening of the magazine pouch. The magazine panel connectors 40 are mounted on a pair of magazine panel connector straps 26.

As seen in the second figure, the present invention has a magazine panel 21 that is connected by a magazine panel connector 40. To a loop on a chest panel. The magazine panel connector 40 has a magazine panel connector clip 41 that selectively engages into a magazine panel connector socket 42. The magazine panel connector clip 41 has a connector clip loop 43 formed of a vertically oriented fabric strip that has a connector clip stitch 44 for securing the connector clip loop 43 to the magazine panel connector clip 41. The magazine panel connector strap upper ends 46 loops around a loop opening 47 of the magazine panel connector clip 41. The loop opening 47 is located at a lower portion of the magazine panel connector clip 41, and is elongated for receiving a vertically oriented fabric strip. The magazine panel connector socket 42 has a magazine panel socket base 45 from which the magazine panel connector socket extends upwardly from. The magazine panel socket base 45 has a slot for connecting to a horizontal fabric loop. The horizontal fabric loop can be a MOLLE standard loop. The magazine panel connector strap upper ends 46 are the upper ends of the magazine panel connector straps 26.

The magazine panel connector 40 is mounted to a mounting loop 49. The mounting loop 49 receives a base tab 54. The base tab 54 has a pair of base tab legs 48 at a lower end of the base tab 54. The base tab 54 has a base tab opening 55 formed at an upper end of the base tab 55. The base tab can be secured to the magazine panel socket base 45 the magazine panel socket base 45 has an upper socket slot opening 52 formed on an inside portion of the magazine panel socket base 45. The magazine panel connector socket 42 is integrally formed with the magazine panel socket base 45 preferably from a single piece of plastic material.

A socket attachment 50 provides a means for attaching the socket to the front panel 17. The socket attachment includes an upper socket slot opening and a lower socket slot opening. The upper socket slot opening 52 cooperates with a lower socket slot opening 51. The magazine panel connector socket 42 can be formed with a socket ridge 53. The socket ridge 53 can be formed as a triangular profile connecting the magazine panel connector socket 42 to the magazine panel socket base 45.

Figure 4:
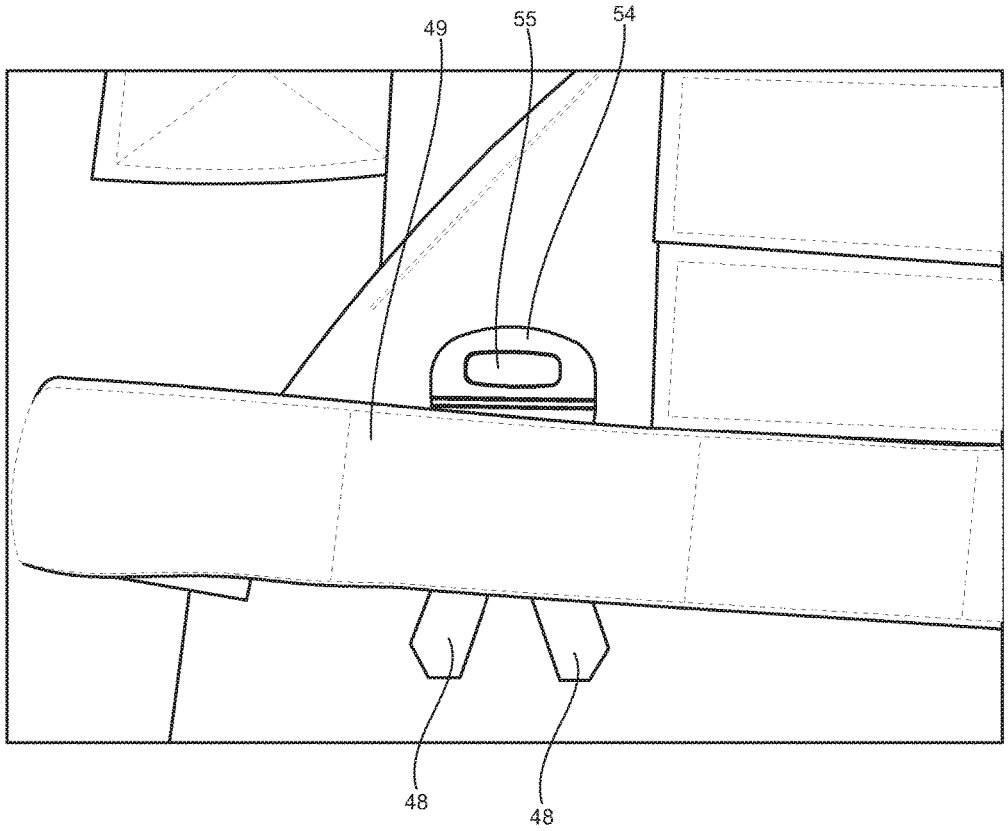
FIG. 4 is a close-up view to show placement of a magazine panel connector socket retainer.
Figure 5:
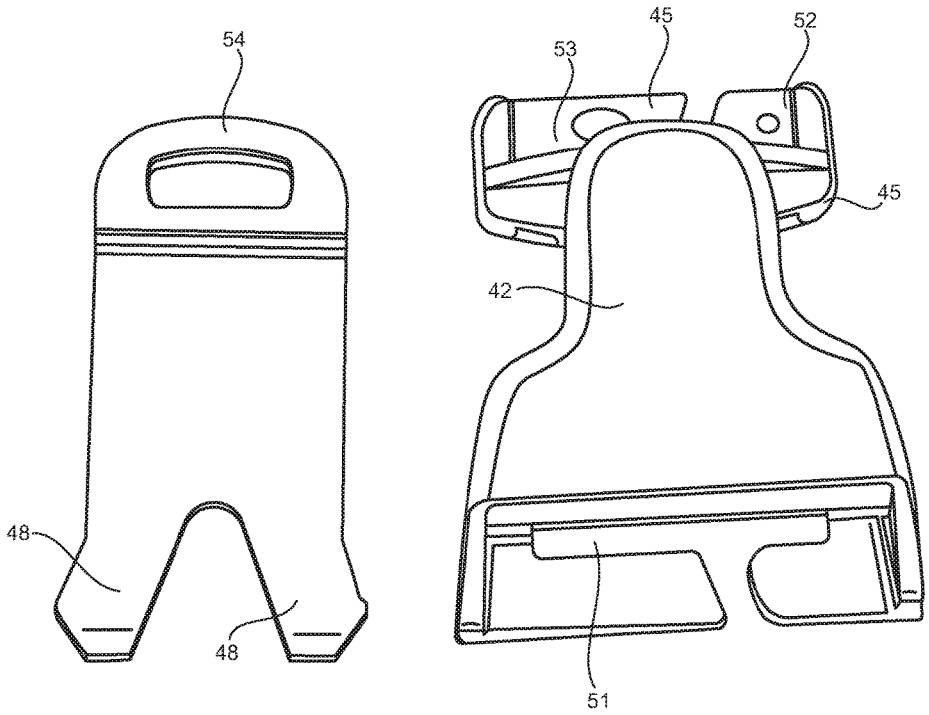
FIG. 5 is an exploded view of the magazine panel connector socket retainer and the magazine panel connector socket.
Figure 6:
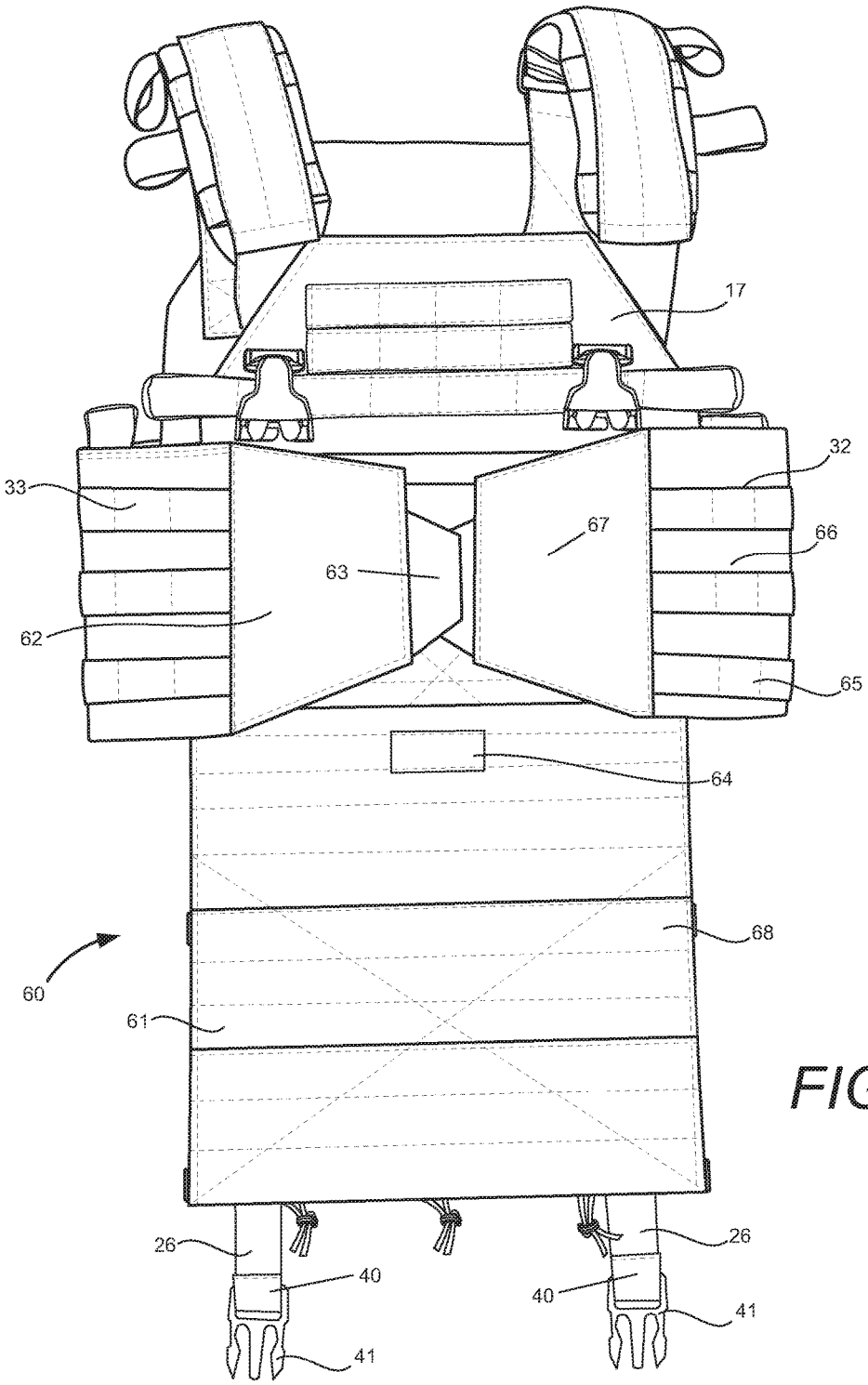
FIG. 6 is a front view of the plate carrier with the magazine panel folded down.
Figure 7:
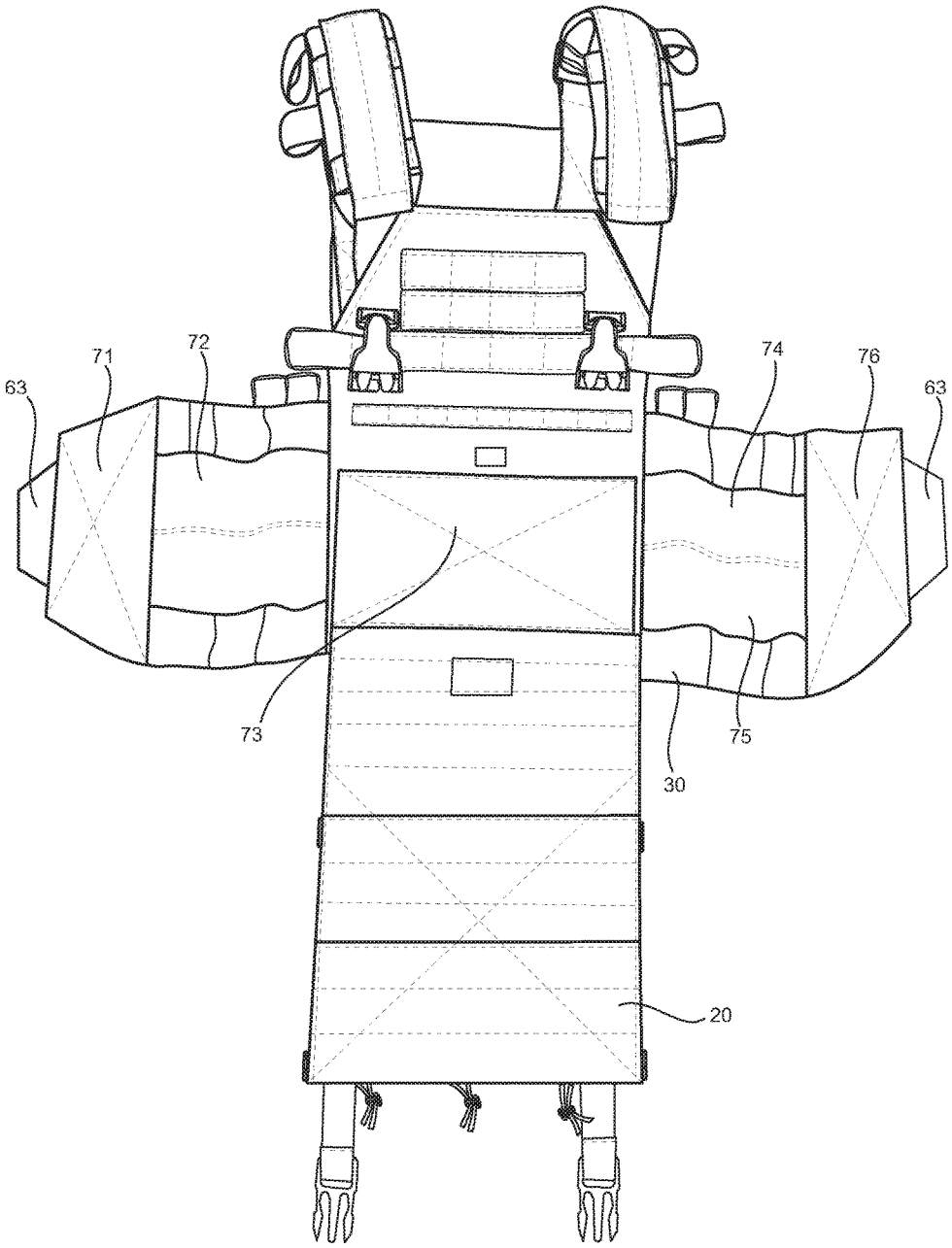
FIG. 7 is a front view of the plate carrier with the magazine panel folded down and the side panels disengaged.

The base tab 54 can connect to the magazine panel connector socket 42 by inserting the base tab 54 into the lower socket opening 51 until the base tab 54 protrudes from the upper socket opening 52. The base tab 54 has an arcuate profile such that it bends away from the magazine panel connector socket 42 so that the base tab 54 can retain to a mounting loop 49 as seen in FIG. 4. As seen in FIG. 5, the base tab 54 has a pair of base tab legs 48 extended apart at an angle with a base tab leg gap between the pair of base tab legs 48. The pair of side panels, namely the left side panel 32 and the right side panel 33 provides a wrap around that connects to the front panel 17 by hook and loop tape connections.

A connector panel system 60 sandwiches the tip ends of the pair of side panels between the front panel and outside flap panel 20 to provide a layered laminate configuration that is durable, but also easily removable. Each of the side panels has a side panel grip projection flap 63 formed as a rubber or plastic sheet protrusion extending from a right side connector panel 62 and extending from a left side connector panel 67. The side panels also have a webbing section that can be a PALS webbing strip arrayed into a webbing panel by providing three rows of webbing strips horizontally parallel to a length direction of the pair of side panels. Each of the webbing strips 65 is segmented into mounting loops to provide a mounting connection for a variety of different tactical equipment.

The side connector panels 62, 67 are attached over the side panel base strips 66. The side panel base strips 66 are preferably made of the fabric as the front panel and the rear panel so that webbing strips 65 and side connector panels can be stitched over the base strips 66. The hook and loop panels preferably have a trapezoidal configuration that tapers to a horizontal edge where the side panel grip projection flap 63 extends therefrom. The side connector panels 62, 67 are preferably oriented to connect to a magazine panel inside surface 61.

The magazine panel inside surface 61 is preferably mounted with a hook panel that connects to loop panels on the ends of the side panels. The right side connector panel 62 is preferably a panel of loops that connects to a panel of hooks on the magazine panel inside surface. Similarly, the left side connector panel 67 preferably has a panel of loops that connects to a panel of hooks on the magazine panel inside surface. The inside surface connector panel 68 is preferably a panel of loops. The magazine panel inside surface can be segmented to allow folding over a folding area 64 of the magazine panel inside surface. The folding area 64 connects the magazine panel to the front panel 17. As a user folds the magazine panel upward, the user engages the inside surface connector panel 68 to the right side connector panels 62 and the left side connector panel 67 which engages the panel of hooks on the magazine panel inside surface to the pair of panels of loops on the side connector panels.

To secure the hook and loop panels together, a user presses a hook panel against a loop panel so that the hooks engage to the loops. An inside view of the body armor in unfurled configuration shows a right inside connector panel 71 formed as a hook panel that engages to a front connector panel 73 formed as a loop panel. Also, the left inside connector panel 76 formed as a hook panel can engage to a front connector panel 73 formed as a loop panel. The right side panel can have a right inside strip 72 extending from the right inside connector panel 71 and the left side panel can have a left inside strip 74 extending from the left inside connector panel 76. The side panels can have a side panel concavity 75 so that the side panels are not completely planar.

A variety of different body armor panels can be inserted including trainer or airsoft body armor panels, ceramic body armor panels, and high density polyethylene body armor panels. The body armor panels generally conform to the shape of the front panel and the rear panel.

The above description refers to the preferred embodiment, and does not limit the scope of the claims. A person of ordinary skill in the art can modify the preferred embodiment and still remain within the scope of the claims. For example, the hook panels and the loop panels can be reversed in position so that the hook panels become the loop panels and the loop panels become the hook panels. Thus, each of the connector panels can be made as either hook or loop connector panels assuming that the opposite connector panel is configured to connect.

The invention claimed is:

1. A plate carrier for carrying body armor comprising:

a. a front panel having a front connector panel;

b. a rear panel behind the front panel;

c. a pair of side panels connected to the rear panel, wherein the pair of side panels includes a right side panel and a left side panel, wherein the right panel includes a right inside connector panel that connects to the front connector panel, wherein the left panel includes a left inside connector panel that connects to the front connector panel; and d. an outside flap panel extending from a lower edge of the front panel, wherein the outside flap panel includes an inside connector panel mounted on an inside surface of the outside flap panel, wherein the inside connector panel overlies the pair of side panels, wherein the right side panel has a right side connector panel, and were in the left side panel has a left side connector panel, wherein the inside connector panel of the outside flap panel secures to the right side connector panel and the left side connector panel when the outside flap panel is folded up to a closed position after the pair of side panels are secured to the front panel, wherein the outside flap is a magazine panel having webbing strips, wherein mounting loops are formed on the webbing strips.

2. A plate carrier for carrying body armor comprising:

a. a front panel having a front connector panel;

b. a rear panel behind the front panel;

c. a pair of side panels connected to the rear panel, wherein the pair of side panels includes a right side panel and a left side panel, wherein the right panel includes a right inside connector panel that connects to the front connector panel, wherein the left panel includes a left inside connector panel that connects to the front connector panel; and d. an outside flap panel extending from a lower edge of the front panel, wherein the outside flap panel includes an inside connector panel mounted on an inside surface of the outside flap panel, wherein the inside connector panel overlies the pair of side panels, wherein the right side panel has a right side connector panel, and were in the left side panel has a left side connector panel, wherein the inside connector panel of the outside flap panel secures to the right side connector panel and the left side connector panel when the outside flap panel is folded up to a closed position after the pair of side panels are secured to the front panel, wherein the outside flap is a magazine panel having a magazine pouch, wherein the outside flap further includes a pair of magazine panel connectors that connect the outside flap to the front panel, wherein the pair of magazine panel connectors are connected to the outside flap by a pair of magazine panel connector straps.

3. The plate carrier for carrying body armor according to claim 2, wherein the inside connector panel is configured to attach to the pair of side panels and secure to the front connector panel when the outside flap panel is folded over the pair of side panels after the pair of side panels are secured to the front panel.

4. The plate carrier for carrying body armor according to claim 2, further including: a pair of shoulder straps connecting the front panel to the back panel.

5. The plate carrier for carrying body armor according to claim 2, wherein the outside flap is a magazine panel having webbing strips, wherein mounting loops are formed on the webbing strips.

6. The plate carrier for carrying body armor according to claim 2, wherein the pair of magazine panel connectors includes a left magazine panel connector and a right magazine panel connector, wherein each of the pair of magazine panel connectors includes a magazine panel connector socket configured to receive a magazine panel connector clip.

7. The plate carrier for carrying body armor according to claim 6, wherein the magazine panel connector socket further includes a lower socket slot opening, and an upper socket slot opening, wherein a base tab is configured to fit through the lower socket slot opening and protrude from the upper socket slot opening, wherein the base tab is removable from the magazine panel connector socket.

8. The plate carrier for carrying body armor according to claim 7, wherein the base tab secures the magazine panel connector socket to a mounting loop.

9. The plate carrier for carrying body armor according to claim 8, wherein the mounting loop is formed on a webbing strip.

10. The plate carrier for carrying body armor according to claim 7, wherein the inside connector panel is configured to attach to the pair of side panels and secure to the front connector panel when the outside flap panel is folded over the pair of side panels after the pair of side panels are secured to the front panel, and further including a pair of shoulder straps connecting the front panel to the back panel.

11. The plate carrier for carrying body armor according to claim 7, wherein three magazine pouches are attached to the magazine panel.

12. The plate carrier for carrying body armor according to claim 1, wherein the inside connector panel is configured to attach to the pair of side panels and secure to the front connector panel when the outside flap panel is folded over the pair of side panels after the pair of side panels are secured to the front panel.

13. The plate carrier for carrying body armor according to claim 1, further including: a pair of shoulder straps connecting the front panel to the back panel.

14. The plate carrier for carrying body armor according to claim 1, wherein the outside flap is a magazine panel having webbing strips, wherein mounting loops are formed on the webbing strips.

15. The plate carrier for carrying body armor according to claim 1, wherein the pair of magazine panel connectors includes a left magazine panel connector and a right magazine panel connector, wherein each of the pair of magazine panel connectors includes a magazine panel connector socket configured to receive a magazine panel connector clip.

* * * * *